US011834931B2

(12) United States Patent
Guillot et al.

(10) Patent No.: US 11,834,931 B2
(45) Date of Patent: Dec. 5, 2023

(54) WELLBORE PLANNER

(71) Applicant: Schlumberger Technology Corporation, Sugar Land, TX (US)

(72) Inventors: Valerian Guillot, Montpellier (FR); Ho Bun Lau, Cambridge (GB); John Morrison Whyte, Cambridge (GB); Florian Karpfinger, Dhahran (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/821,172

(22) Filed: Aug. 21, 2022

(65) Prior Publication Data

US 2023/0053857 A1 Feb. 23, 2023

Related U.S. Application Data

(60) Provisional application No. 63/260,448, filed on Aug. 20, 2021.

(51) Int. Cl.

| | |
|---|---|
| ***E21B 21/00*** | (2006.01) |
| ***E21B 41/00*** | (2006.01) |
| ***E21B 49/00*** | (2006.01) |

(52) U.S. Cl.

CPC ..... *E21B 41/00* (2013.01); *E21B 21/003* (2013.01); *E21B 49/00* (2013.01); *E21B 2200/20* (2020.05); *E21B 2200/22* (2020.05)

(58) Field of Classification Search

None

See application file for complete search history.

(56) References Cited

U.S. PATENT DOCUMENTS

| | | | | |
|---|---|---|---|---|
| 2003/0079912 | A1* | 5/2003 | Leuchtenberg | E21B 44/00 175/48 |
| 2009/0299714 | A1* | 12/2009 | Kelkar | G01V 99/00 703/10 |
| 2010/0181073 | A1 | 7/2010 | Dupriest et al. | |
| 2013/0341093 | A1* | 12/2013 | Jardine | E21B 7/00 703/2 |
| 2017/0052272 | A1* | 2/2017 | Maeso | G01V 3/30 |
| 2019/0323332 | A1* | 10/2019 | Cuellar | E21B 21/003 |
| 2020/0174152 | A1 | 6/2020 | Kesserwan et al. | |

* cited by examiner

*Primary Examiner* — Andrew Sue-Ako

(74) *Attorney, Agent, or Firm* — Jeffrey D. Frantz

(57) ABSTRACT

A downhole wellbore planner builds a fracture model of a wellbore using fracture data identified from geological information. Using the fracture model and a target wellbore location at the formation, the wellbore planner may identify or select one or more lost circulation materials (LCMs). The drilling operator may then procure the LCMs before drilling the wellbore. In this manner, the impact of a lost circulation event may be reduced by having the LCMs on site or nearby.

14 Claims, 9 Drawing Sheets

WELLBORE PLANNER

CROSS-REFERENCE TO RELATED APPLICATIONS

This application claims the benefit of, and priority to, U.S. Patent Application Ser. No. 63/260,448, filed Aug. 20, 2022, which application is expressly incorporated herein by this reference in its entirety.

BACKGROUND

Traditional wellbore drilling practices attempted to drill wells as near to the vertical as possible; however, it is now common to drill directional or deviated wells by directing a drill bit along a defined trajectory to a predetermined target. With increased directional drilling capabilities, there has been an increased desire for directional drilling, and directional drilling is being applied in myriad applications and formations, causing wellbore trajectories to become increasingly more complex.

Wellbore trajectory planning can be accomplished by, for instance, plotting together a series of curve and hold sections, and then reviewing and repeating this for the sections until well planners obtain a satisfactory trajectory. During this process, trajectories may be evaluated based on formation, drilling, or trajectory parameters such as formation type and properties, dog-leg severity, torque, drag, and drilling rig requirements or limitations.

After drilling commences, it may be realized that the tools may have deviated from the plan or that the pre-planned trajectory may not arrive at the desired target, and that a trajectory correction should be applied. Alternatively, it may be determined that the desired target has changed, and that the trajectory should change to reach the new target. Trajectory planning may therefore occur offline before drilling starts, but also in near real-time to control or re-plan the trajectory.

SUMMARY

In some embodiments, a method for wellbore planning includes receiving geological information about a formation. Fracture characteristics are identified in the formation using the geological information. A fracture model of the formation is built using the fracture characteristics. Based at least in part on the fracture model, one or more lost circulation treatments are identified to mitigate a lost circulation event.

In some embodiments, a method for wellbore planning includes, before performing a drilling operating, building a fracture model of a formation through which a wellbore will be drilled. The fracture model includes fracture characteristics that are extrapolated from one or more offset wellbores. A target wellbore path is identified through the formation. Expected fracture properties are identified for the target wellbore path from the fracture model. Based at least in part on the expected fracture properties, one or more lost circulation materials are identified for the target wellbore path.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a representation of geological information used to create a fracture model, according to at least one embodiment of the present disclosure;

FIG. 2-2 is a representation of a fracture model generated from the geological information of FIG. 2-1;

DETAILED DESCRIPTION

This disclosure generally relates to devices, systems, and methods for wellbore planning and lost circulation event mitigation. Using geological information from offset wellbores, a fracture model may be developed for a formation. The fracture model may include fracture characteristics, such as fracture thickness, width, depth, dip, strike, and so forth. Using the fracture model, a wellbore planner may identify, recommend, or select one or more lost circulation materials (LCMs) for use in a lost circulation event. The fracture model and LCM recommendation may be performed before the wellbore is drilled. In this manner, the drilling operator may have the identified LCM on site, thereby limiting the impact of a lost circulation event.

Figure 1:
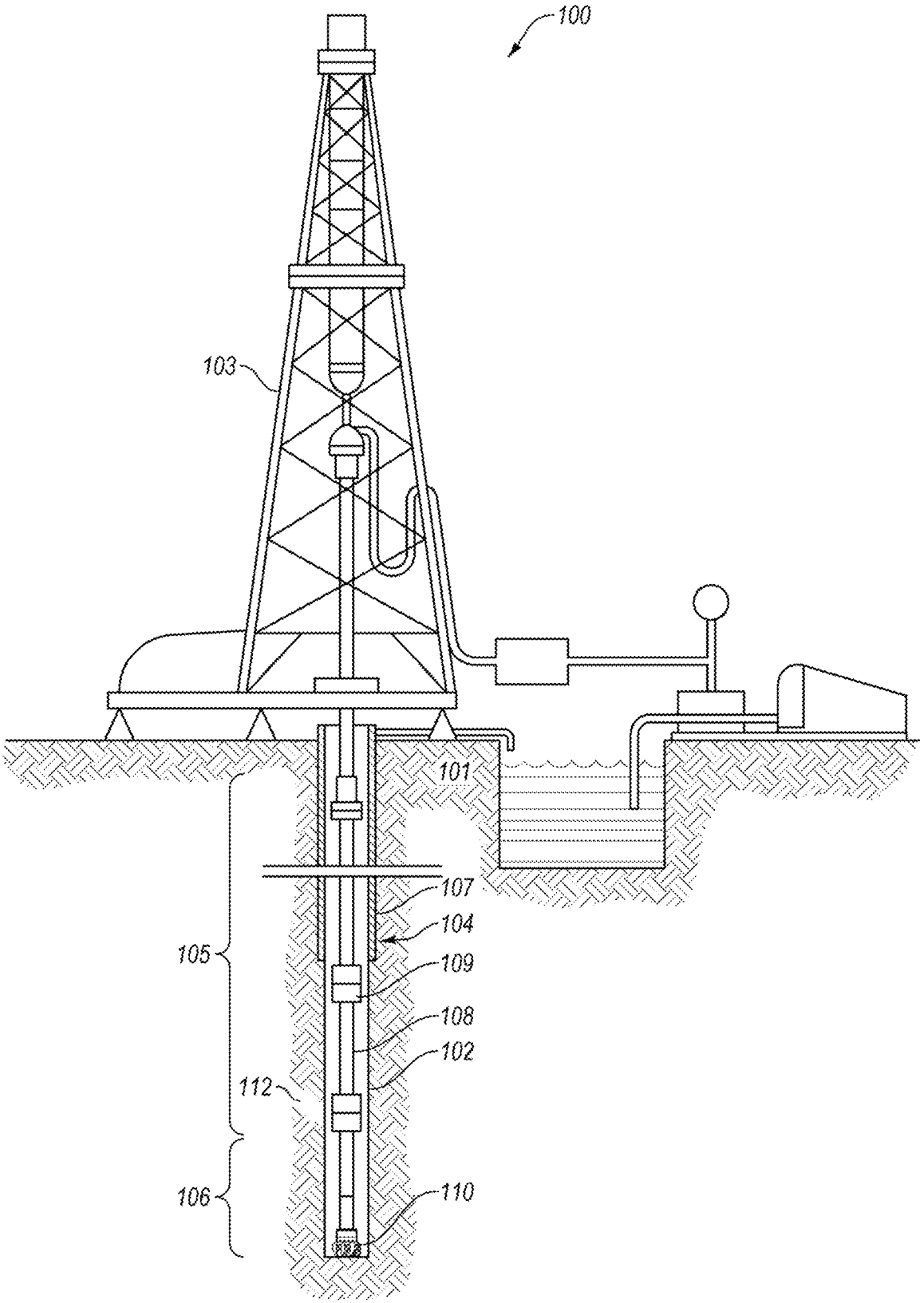
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a downhole drilling tool assembly 104 which extends downward into the wellbore 102. The downhole drilling tool assembly 104 may include a drill string 105, a bottomhole assembly (BHA) 106, and a bit 110, attached to the downhole end of drill string 105. In some embodiments, the downhole drilling tool assembly 104, or elements of the downhole drilling tool assembly 104, may be configured to erode the formation. For example, the bit 110, a reamer, a casing cutter, any other downhole drilling tool, and combinations thereof may be configured to erode or degrade the formation to advance the wellbore and/or make a change to a dimension or other part of the wellbore.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the downhole drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

In some situations, during drilling operations, the formation may include one or more fractures 112 or fracture networks. A fracture 112 may be any break, fracture, fissure, hole, void, karst, or other space in a rock or series of rocks. An individual fracture 112 may have a thickness, a width, a length, a strike, and a dip. The thickness, width, and length may the geometrical properties of the fracture 112, with the thickness being the shortest distance between opposing sides of the fracture 112, and width and length being the geographical extent in directions transverse to the thickness. For simplicity of description, thickness may be considered the extent of the fracture 112 in the z-axis, width the extent of the fracture 112 in the x-axis, and length the extent of the fracture 112 in the y-axis. The dip may be the angle that the fracture 112 is oriented from horizontal, and the strike may be the horizontal orientation of the fracture 112. The thickness, length, and/or width of the fracture 112 may impact how much fluid may travel through the fracture 112. A fracture 112 having a greater thickness may transmit more fluid, and a fracture 112 having a greater length and/or width may transmit fluid further and/or transmit more fluid.

In some situations, if a wellbore intersects a fracture 112, drilling fluid in the wellbore may travel into and/or through the fracture 112. For example, as the wellbore advances, the bit may intersect one or more fractures 112, or a fracture network that includes a plurality of interconnected or fluidly connected fractures 112. Drilling fluid may enter the fracture 112 that intersects the wellbore. The drilling fluid may then be transmitted to adjacent fractures in fluid communication with the intersecting fractures. In some situations, the drilling fluid may travel into the formation and be "lost," or be removed from circulation. In some situations, circulation of the drilling fluid may be partially or fully lost in a lost circulation event, meaning that drilling fluid that is pumped into the wellbore is not returned to the surface. This may result in a reduced in drilling efficiency and/or drilling effectiveness, and may result in damage to downhole tools.

To mitigate a lost circulation event, a drilling operator may implement a lost circulation treatment. Lost circulation treatments may include changing one or more drilling parameters to attempt to restore circulation. Such drilling parameters may include changing properties of the drilling fluid, such as drilling fluid density, viscosity, composition, any other drilling fluid property, and combinations thereof. In some situations, a lost circulation treatment may include the introduction of a lost circulation material (LCM). An LCM may be a material that infiltrates the one or more fractures 112 and reduces the transmissibility of the drilling fluid. LCMs may plug the fractures in many different ways, including physically and/or chemically. A chemical LCM may be a fluid or series of suspended that infiltrates the fractures 112. A chemical reaction may cause the fluid to solidify, thereby plugging the fractures 112. A physical LCM may include particles of a particular size and/or composition that may infiltrate the fractures 112. Stacking of the particles may partially or fully plug the fracture.

In accordance with embodiments of the present disclosure, a drilling operator, using data collected from offset wellbores that intersect the target formation, may generate a fracture model of the fracture network in the formation. The fracture model may be extrapolated from the data collected from the offset wellbores. In some embodiments, the fracture model may include the extrapolated thickness, width, length, dip, and azimuth, and other features of the fractures. In some embodiments, the fracture model may include the interconnectivity of individual fractures in the fracture network.

In some embodiments, using the fracture model, the drilling operator may identify one or more LCMs to use if a lost circulation event occurs. For example, a drilling operator may have a list of available LCMs. Each LCM has particular properties that may optimize that LCM for a fracture 112 or fracture network. For example, the particle size of the LCM may be selected based on the thickness of the fracture 112. The drilling operator may select a particle size of LCM that is small enough to fit in the fracture 112, but large enough to become lodged in the fracture 112. In this manner, the LCM may plug the fracture 112. Selecting an LCM based on the fracture model may allow the drilling operator to plug the fracture network with the first LCM attempt, rather than working through LCMs on a trial-and-error basis. This may reduce downtime due to a lost circulation event and/or reduce the cost associated with a lost circulation treatment.

In some embodiments, the fracture model may be generated using geological information about the formation through which the target wellbore will be drilled. For example, the fracture model may be generated geological information from offset wellbores that drilled through the same formation. Offset wellbores may include any type of wellbores, including exploration wellbores, core holes, production wellbores, any other wellbore, and combinations thereof.

In some embodiments, the geological information may include any type of geological information. For example, the geological information may include visual information (e.g., visual information obtained from borehole images, borehole scopes, and so forth), seismic information, resistivity information (e.g., a difference in resistivity between a fracture 112 and the solid formation), rock type, rock density, information about lost circulation events in the formation, any other type of geological information, and combinations thereof. The geological information may be used to identify the fractures 112, including identifying the fracture thickness, width, length, dip, strike, fracture density, and so forth.

Figures 1, 2:
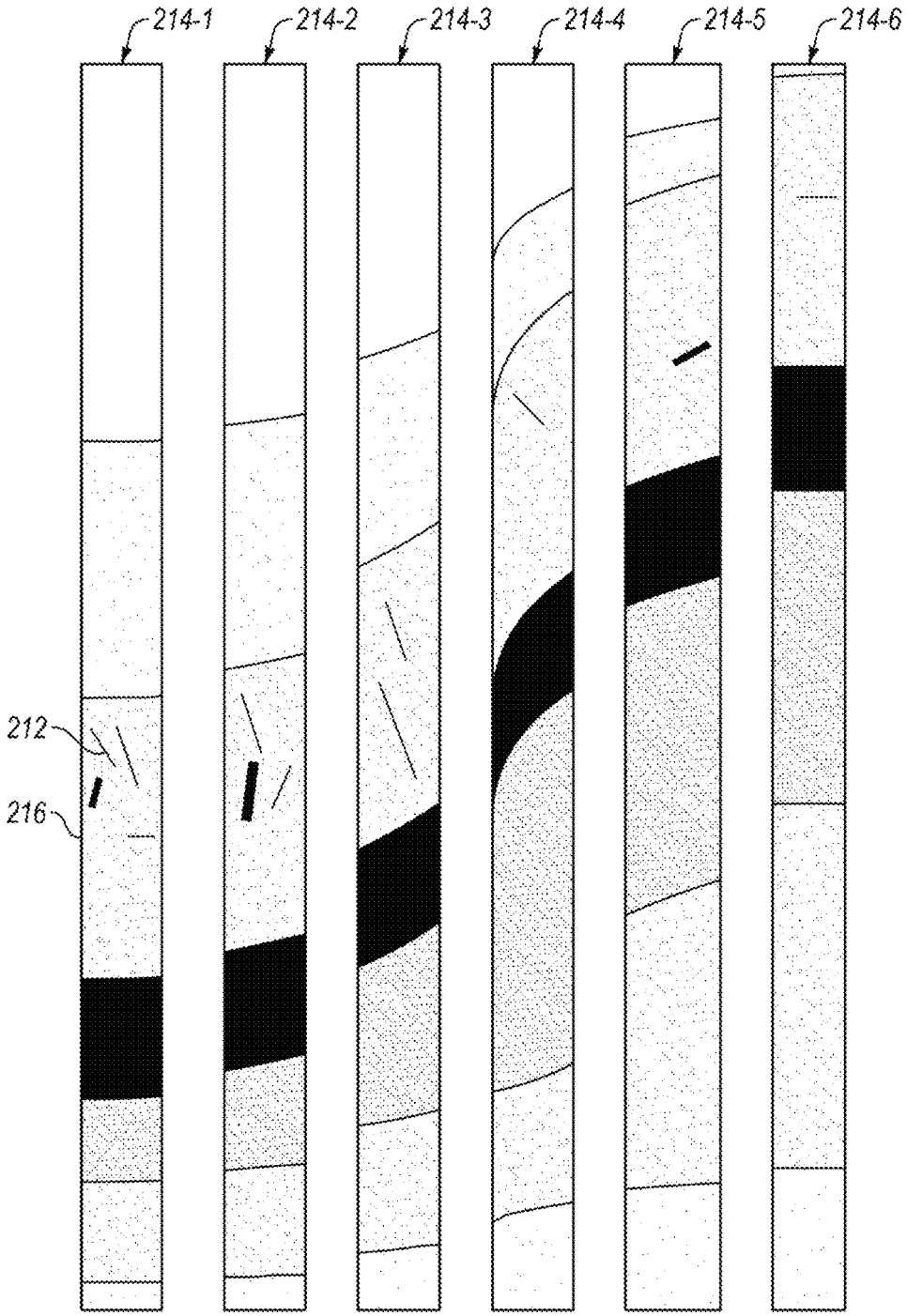
Figure 2:
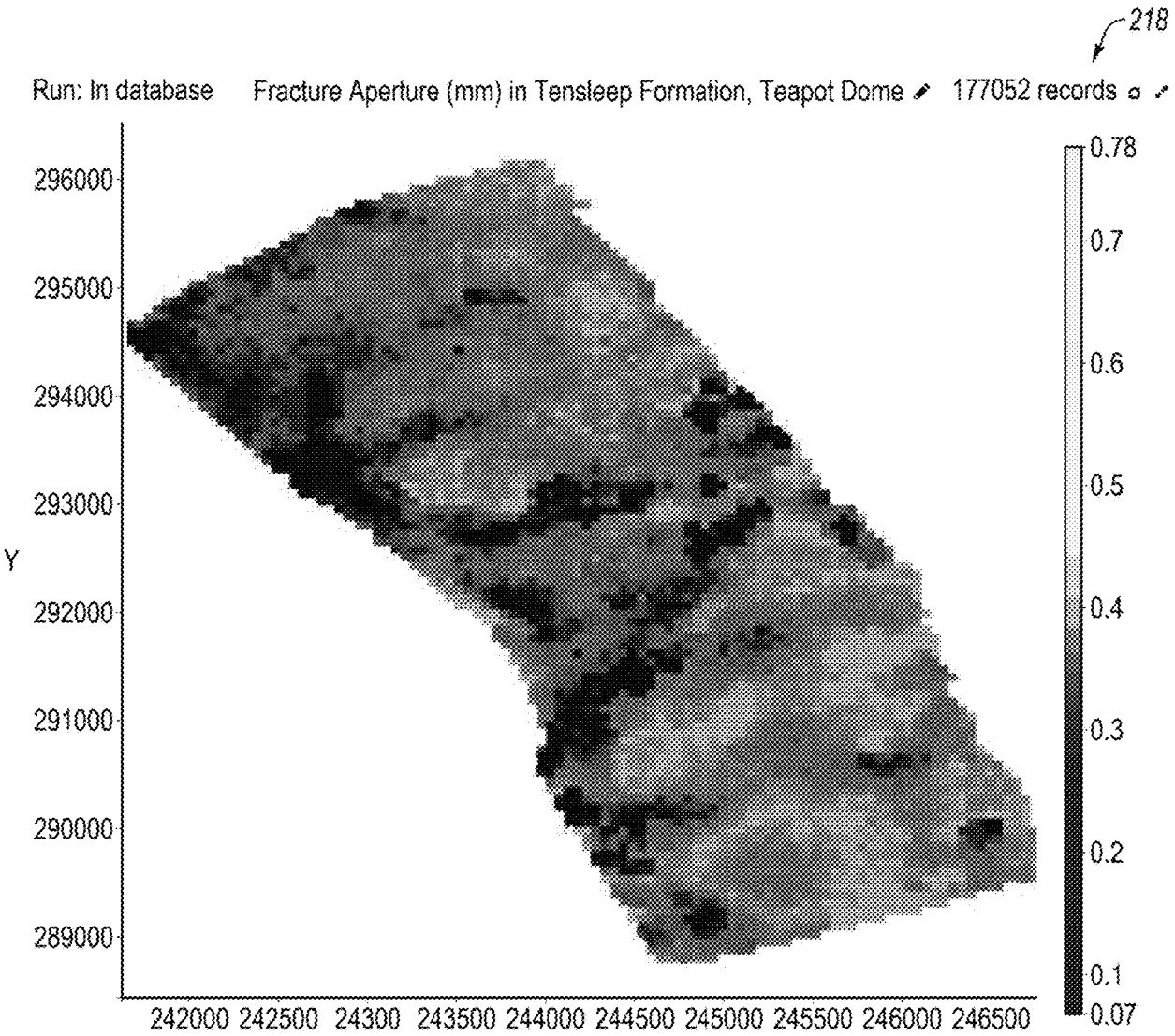

As may be seen in FIG. 2-1, geological data from a series of offset wellbores (collectively 214) may be used to identify trends and/or patterns between fractures 212 of a formation 216. It should be understood that the offset wellbores 214 may be located at any distance and any azimuth away from each other and a target wellbore. Each of the offset wellbores 214 intersect and/or include geological information about the formation 216. The geological information may be used to identify characteristics of the fractures 212. For ease of illustration, the fractures 212 are shown having a length, orientation, and a line thickness. The length and orientation may represent the extent and direction of the fracture 212, respectively, while the line thickness may be representative of the thickness of the fracture 212.

A drilling operator and/or fracture model generator may analyze the fractures 212 in the formation 216 between the different offset wellbores 214 and identify patterns between the fractures 212 identified in different wellbores. For example, the fracture model generator may identify that the fractures in the formation 216 generally have a low thickness and have a steep orientation (represented by the generally thin lines representing the fractures 212 and the generally vertical orientation). The fracture model generator may develop a fracture model indicating averages of fracture size and density.

As may be seen, size, density, and/or orientation of the fractures 212 may vary between offset wellbores 214. For example, in the embodiment shown, the fractures 212 in a first offset wellbore 214-1 may have a higher fracture density (e.g., more fractures per vertical and/or horizontal extent) than the fractures 212 of the second offset wellbore 214-2. The fractures 212 in the second offset wellbore 214-2 may, in turn, have a higher fracture density than the fractures 212 in a third offset wellbore 214-3, which may have a higher fracture density than the fractures 212 in a fourth offset wellbore 214-4. The fractures 212 in a fifth offset wellbore 214-5 may have a larger thickness than the fractures in the sixth offset wellbore 214-6. While fracture density and/or fracture thickness have been discussed and shown herein, it should be understood that any other fracture property may be inferred or determined from the geological information shown in the offset wellbores.

Using the identified fractures 212 and their properties, the fracture network generator may generate a fracture network. In some embodiments, the generated fracture network may be generated for the formation 216. In some embodiments, the generated fracture network may be generated for a series of formations or strata. For example, a series of formations or strata may include similar fractures and/or share a fracture network. The fracture network may be used to develop a fracture network map, such as the fracture network map 218 shown in FIG. 2-2. The fracture network map 218 may be calibrated to show in color or grayscale a particular fracture network property, such as average fracture thickness, maximum fracture thickness, average fracture density, fracture connectivity, fracture orientation (e.g., dip and/or strike), fracture length and/or width, any other fracture network property, and combinations thereof. In some embodiments, the fracture network may include fracture network properties for particular geographical coordinates.

In some embodiments, the fracture network property may include drilling fluid transmissibility. Drilling fluid transmissibility may be a measure of how well drilling fluid may travel through the fracture network, with a high transmissibility being associated with more drilling fluid traveling through the fracture network. In some embodiments, drilling fluid transmissibility may be determined using a combination of other fracture network properties. For example, a fracture network having a high fracture density and a high fracture connectivity may have a high transmissibility. A fracture network having a high average fracture thickness and a low fracture connectivity may have high or medium transmissibility. Drilling fluid transmissibility may be related to many different fracture network properties.

In some embodiments, the drilling fluid transmissibility may be associated with the risk of a wellbore having a lost circulation event. For example, a high drilling fluid transmissibility may be associated with a high risk of a lost circulation event. If a target wellbore passes through a zone having a high risk of a lost circulation event, then the target wellbore may therefore be at risk of a lost circulation event. If the target wellbore is at risk of a lost circulation event, the drilling operator may be able to prepare to mitigate the lost circulation event with a lost circulation treatment, such as an LCM.

In some embodiments, an LCM identifier may identify one or more LCMs from a list of LCMs that may be effective in the event of a lost circulation event. The LCM identifier may take into account the properties of the various LCMs and compare them to the fracture network properties. For example, the LCM identifier may analyze properties from a table such as Table 1, which includes a list of particle diameters for various LCMs, in micrometers. In Table 1, the values in column d10 are the particle size that 10% of the particles of the LCM are equal to or less than, the values in column d25 are the particle size that 25% of the particles of the LCM are equal to or less than, and so forth. The LCM identifier may then identify or recommend one or more LCMs that may be appropriate or effective for a lost circulation event. For example, the LCM identifier may analyze the particle size distribution of an LCM from Table 1 and compare it to the average thickness and/or thickness profile (e.g., the range of thicknesses of fractures) of the fracture network. If the particle size distribution is complementary to the average thickness (e.g., the particles of the LCM may enter the fractures to clog the fractures), then the LCM may be recommended for the target wellbore. In some examples, the LCM identifier may analyze other LCM properties, such as particle shape, maximum particle size, minimum particle size, any other LCM property, and combinations thereof to provide recommendations for the wellbore.

TABLE 1

Particle size distribution of various LCMs

| LCM | d10 | d25 | d50 | d75 | d90 |
|---|---|---|---|---|---|
| LCM 1 | 2 | 5 | 10 | 13 | 20 |
| LCM 2 | 100 | 110 | 180 | 230 | 300 |
| LCM 3 | 10 | 15 | 25 | 35 | 55 |
| LCM 4 | 2 | 20 | 60 | 90 | 120 |
| LCM 5 | 5 | | 80 | | 240 |

In some embodiments, a drilling operator may procure the identified and/or recommended LCM prior to drilling the wellbore or performing drilling operations. The drilling operator may store the recommended LCM on site. If a lost circulation event occurs, the drilling operator may utilize the LCM that is on site to mitigate the lost circulation event. Because the LCM is on site, and has been selected based on the fracture model, there is an increased chance that the LCM will be effective. This may help to reduce the impact of an LCM on the overall drilling rate, which may reduce the cost of the wellbore. This may further help to reduce the cost of lost circulation treatments. In some embodiments, this may help to prevent the loss of the wellbore due to lost circulation.

Figure 3:
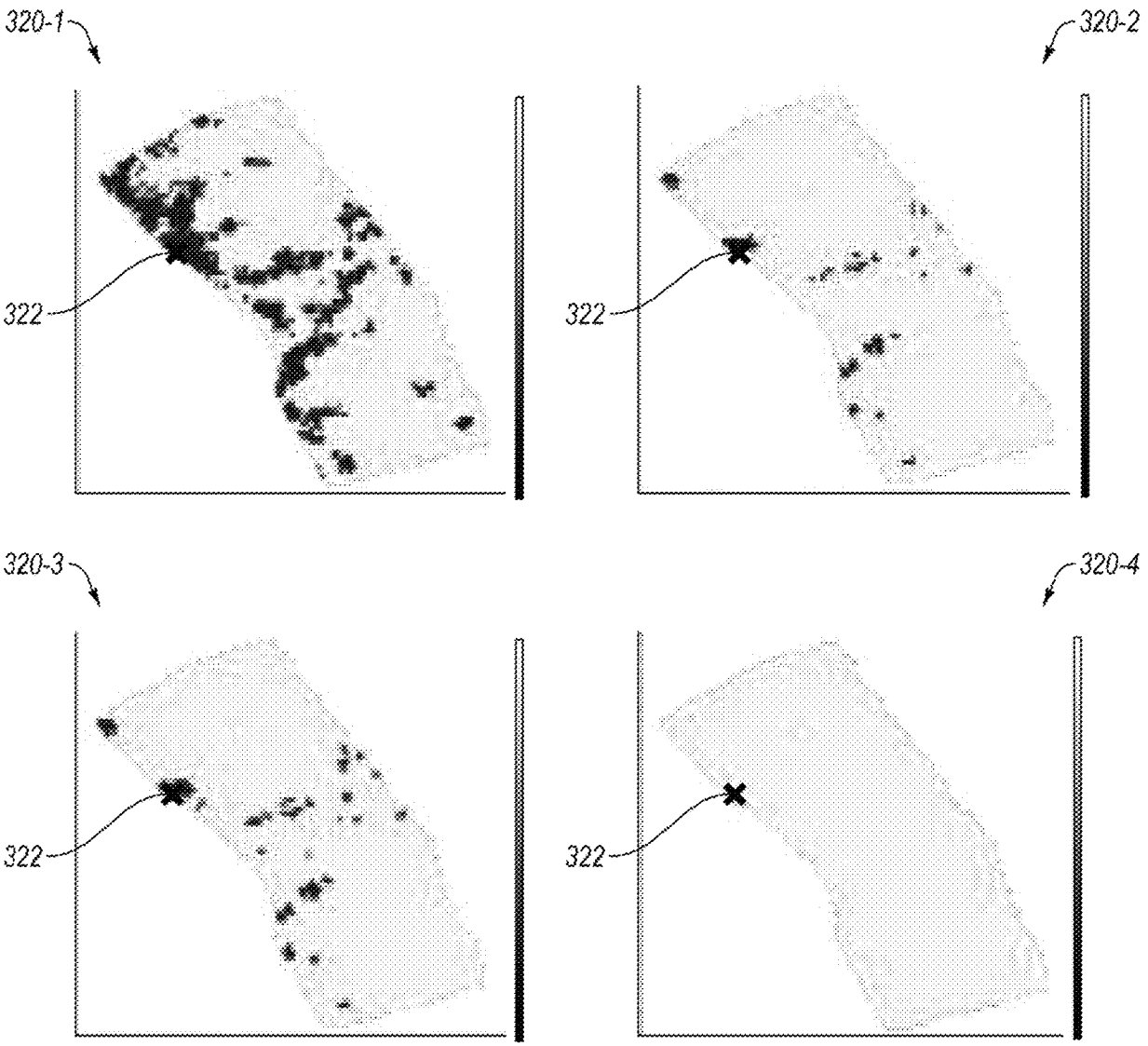
FIG. 3 is a representation of a series of use maps, according to at least one embodiment of the present disclosure.

In some embodiments, the LCM identifier may provide one or more use maps that provide an indication how well a particular LCM will perform at a particular location of the fracture network map 218. In FIG. 3, the fracture network map 218 of FIG. 2 has been converted to a use map (collectively 320) for various LCMs. Using the fracture network map 218, the LCM identifier may determine whether a particular LCM will be effective for at different locations. For example, a first use map 320-1 may be associated with a first LCM, where white is an indication of where the first LCM will likely be effective and black is an indication of where the first LCM will likely be ineffective. Using a target wellbore location 322, which may be a location in the formation through which a target wellbore is projected to travel, the drilling operator may determine whether the LCM will be effective if a lost circulation event occurs. As may be seen, the first use map 320-1 indicates that the first LCM will likely be ineffective at the target wellbore location 322.

Reviewing the second use map 320-2 of a second LCM, there are more areas where the second LCM will likely be effective. However, at the target wellbore location 322, the second LCM will still likely not be effective. In the third use map 320-3, different areas of effectiveness are shown, with the target wellbore location still being likely ineffective. In the fourth use map 320-4, the fourth LCM appears to be effective in all locations, including at the target wellbore location 322. Using the use maps 320 of FIG. 3, the drilling operator may determine or select which LCM to use, procure, or otherwise maintain in stock for drilling operations. For example, using the use maps 320 of FIG. 3, the drilling operator may determine that the fourth LCM will likely be the most effective for the formation shown at the target wellbore location 322. In this manner, a drilling operator may be able to procure in advance and/or maintain in stock the appropriate LCM for a wellbore. Furthermore, in the event of a lost circulation event, the drilling operator may be able to sooner utilize the appropriate LCM to mitigate the lost circulation event. In this manner, the drilling operator may mitigate the lost circulation event sooner, thereby reducing the amount of downtime caused by the lost circulation event. This may save time, money, and may prevent the loss of a wellbore due to a lost circulation event.

While the use maps 320 of FIG. 3 are shown as binary systems, where the LCM mapped is either effective or ineffective, it should be understood that different use maps 320 may be generated. For example, one or more use maps may be generated of a heat map of the predicted effectiveness of the selected LCM. The heat map may provide the probability of mitigating the LCM at a particular location along the formation. In some embodiments, the use map may include different colors or other identifiers for regions where a particular LCM may be effective so that a user may analyze a single use map and identify which LCM to use for a target wellbore location.

Figure 4:
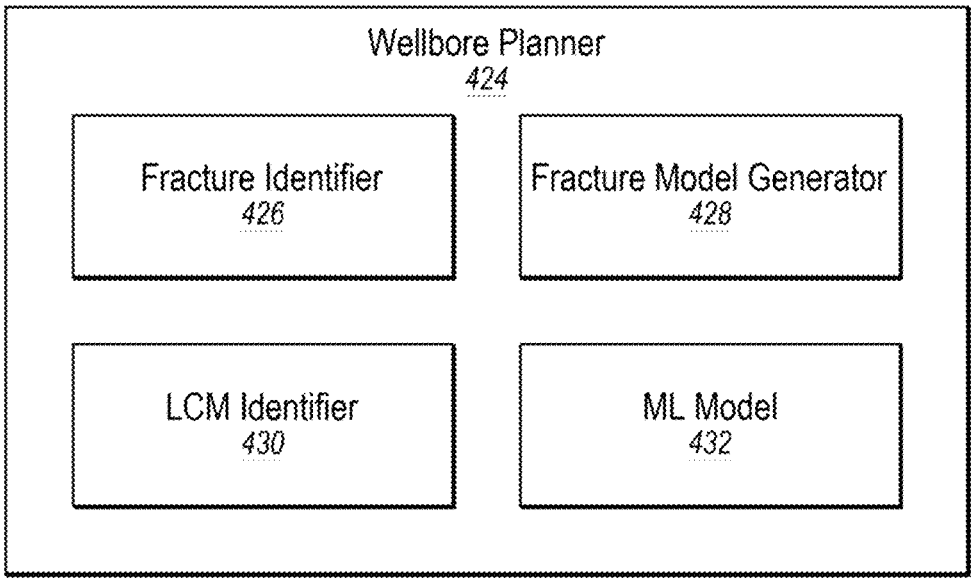
FIG. 4 is a representation of a wellbore planner, according to at least one embodiment of the present disclosure.

FIG. 4 is a representation of a wellbore planner 424, according to at least one embodiment of the present disclosure. The wellbore planner 424 includes a fracture identifier 426, which may take geological information, such as from offset wellbores, and identify one or more fractures. The fracture identifier 426 may identify fractures from any type of geological information, including visual information (e.g., visual information obtained from borehole images, borehole scopes, and so forth), seismic information, resistivity information, information about lost circulation events in the formation, any other type of geological information, and combinations thereof. The fracture identifier 426 may identify fracture characteristics of the fractures, such as fracture thickness, width, length, dip, strike, any other fracture characteristics, and combinations thereof.

Using the fracture information from the fracture identifier, a fracture model generator 428 may generate one or more fracture models for a particular formation, stratum, groups of formations, strata, and combinations thereof. The fracture model may utilize fracture information from multiple offset wellbores to generate trends and/or averages of fracture information across an area of the formation. The fracture model may be generated as a 2 or 3 dimensional map of the formation based on any of the fracture properties.

Using the fracture model, an LCM identifier 430 may analyze the averages and trends of fracture properties of the fractures and identify one or more LCMs that may be suitable and/or effective as a lost circulation treatment for a lost circulation event. The LCM identifier 430 may create one or more use maps that may identify areas of the formation where an LCM may be effective. For example, multiple use maps may be created by the LCM identifier for multiple different LCMs. A drilling operator may analyze a target wellbore location for a target wellbore on the use map and determine whether the LCM will be effective. In some embodiments, the use map may include multiple LCMs on the same map, with different locations on the map being associated with the LCM that may be identified as the most effective for that particular location.

In some embodiments, the LCM identifier 430 may generate a recommendation for which LCM to use for a particular target wellbore location. For example, the LCM identifier 430 may analyze a table or other database of LCMs and select or recommend a particular LCM or set of LCMs for a particular target wellbore. This may help the drilling operator to prepare for a lost circulation event while drilling the wellbore, thereby reducing the potential impact of a lost circulation event on the wellbore. In some embodiments, the LCM identifier 430 may provide a prediction regarding the amount of LCM that may be used to mitigate a lost circulation event. A prediction of the amount of LCM to be used may further help the drilling operator to procure and/or stock the appropriate amount of LCM to mitigate a lost circulation event.

In accordance with embodiments of the present disclosure, the wellbore planner may include one or more machine learning (ML) models 432. For example, the fracture identifier 426 may use a ML model 432 to identify fractures using geological information. The ML model 432 may be refined using measured observations associated with the geological information. In some embodiments, the fracture model generator 428 may utilize a ML model 432 to generate the fracture models. For example, the fracture model generator 428 may generate a fracture model using the fracture information from the fracture identifier 426. When the wellbore is drilled through the fracture model, the predictions from the model may be compared to the observed conditions of the wellbore. The ML model 432 may be refined using the observed conditions by comparing the observed conditions to the predicted conditions. In some embodiments, the LCM identifier 430 may use a ML model 432 to provide recommendations or predictions for the effectiveness of a particular LCM. Put another way, the ML model 432 identifies the LCM to be used in the formation. If an LCM is used to mitigate a lost circulation event, the effectiveness of the LCM may be compared to the recommended effectiveness. This comparison may, in turn, be used to update the ML model 432. Utilizing a ML model 432 may help to provide more representative recommendations and/or predictions by the fracture identifier 426, the fracture model generator 428, and/or the LCM identifier 430.

Figure 5:
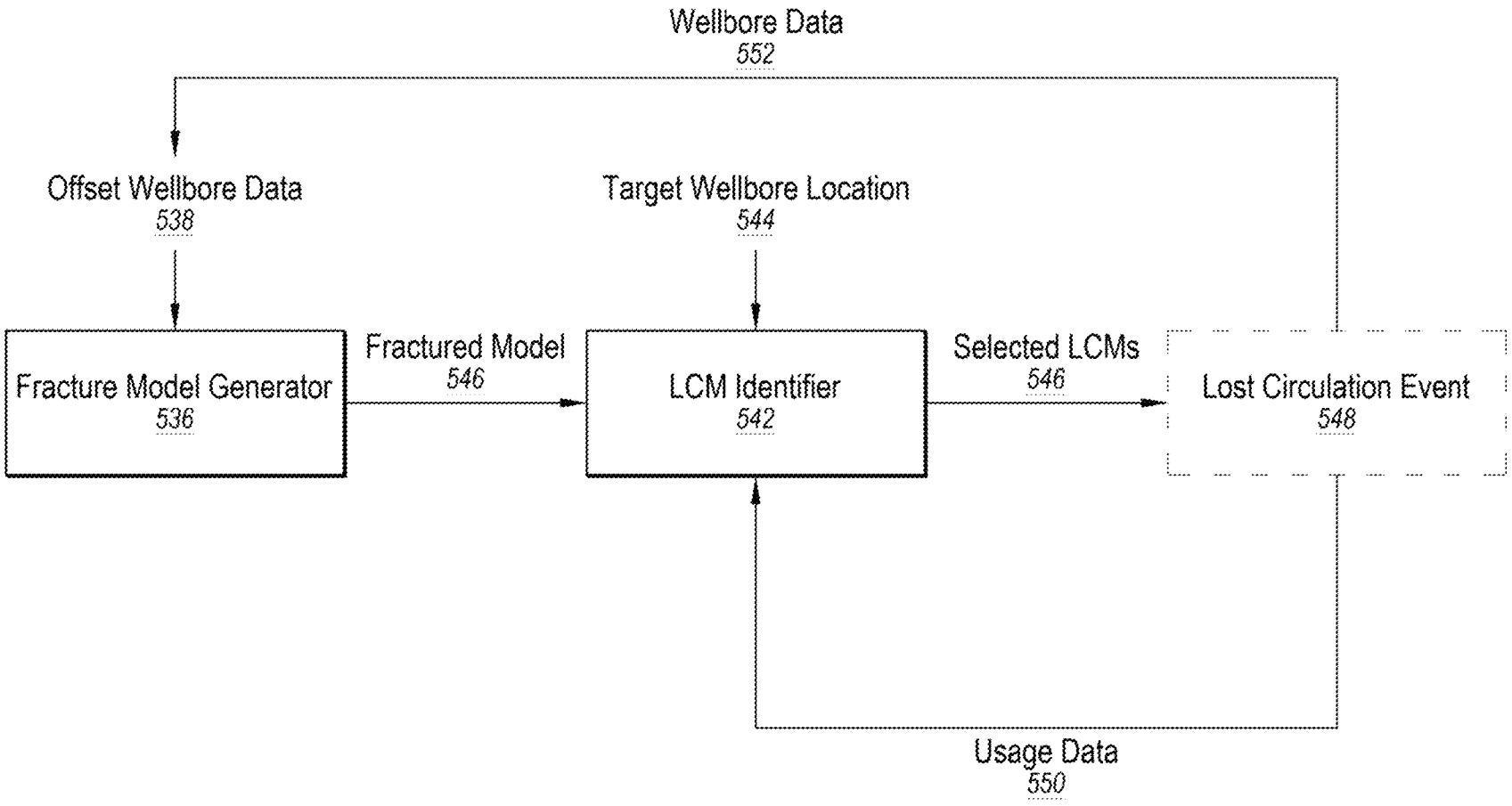
FIG. 5 is a representation of a machine learning model, according to at least one embodiment of the present disclosure.

FIG. 5 is a representation of a ML model 534 to be used by a wellbore planning system, according to at least one embodiment of the present disclosure. The ML model 534 may be implemented by the wellbore planner 424 of FIG. 4. Put another way, one or more elements of the wellbore planner 424 of FIG. 4 may implement the ML model 534.

The ML model 534 includes a fracture model generator 536 which may receive offset wellbore data 538 as input. The offset wellbore data 538 may include geological information about a formation through which the wellbore may be drilled, as discussed herein. Using the offset wellbore data 538, the fracture model generator 536 may generate a fracture model 540. The fracture model 540 may be used by an LCM identifier 542. The LCM identifier 542 may analyze the fracture model 540 and provide recommendations for one or more LCMs to use in a lost circulation event.

In some embodiments, the LCM identifier 542 may receive a target wellbore location 544 of a target wellbore at the formation for which the fracture model 540 has been generated. Using the fracture model 540 and the target wellbore location 544, the LCM identifier 542 may generate one or more use maps that provide an analysis and/or recommendation of LCMs to use at a particular location. In some embodiments, the LCM identifier may select one or more selected LCMs 546.

The selected LCMs 546 may then be used in a lost circulation event 548. The drilling operator may collect usage data 550 of the performance of the selected LCMs 546. The usage data 550 may include the effectiveness of the particular LCM to mitigate the lost circulation event 548. The LCM identifier 542 may be modified to a refined LCM identifier 542, which may produce refined selected LCMs 546 to use on the next wellbore and/or lost circulation event.

Furthermore, when the target wellbore has been drilled, updated wellbore data 552 may be developed. When planning the next target wellbore, the fracture model generator 536 may use the updated wellbore data 552 to produce a refined fracture model 540. Using both the updated wellbore data 552 and the usage data 550 of the LCM, the ML model 534 may be refined and produce more representative recommendations of the LCM to be used, thereby further reducing the impact of a lost circulation event.

Figure 6:
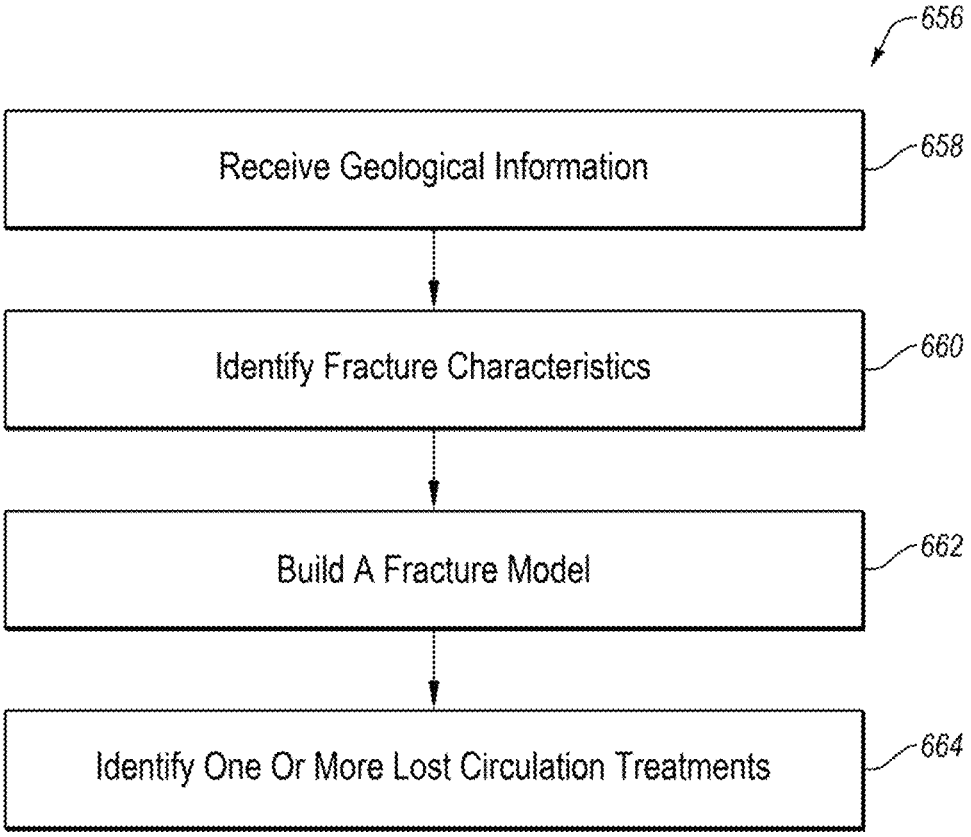
FIG. 6 is a flowchart of a method for planning a wellbore, according to at least one embodiment of the present disclosure.

FIG. 6 is a flowchart of a method 656 for planning a wellbore, according to at least one embodiment of the present disclosure. The method 656 includes receiving geological information about a formation at 658. As discussed herein, the geological information may include any geological information, including survey information, seismic information, visual information (e.g., visual information obtained from borehole images, borehole scopes, and so forth), resistivity information, information about lost circulation events in the formation, and so forth. Using the geological information, fracture characteristics about the formation may be identified at 660. The fracture characteristics may then be used to develop a fracture model of the formation at 662. Based at least in part on the fracture model, one or more lost circulation treatments may be identified to mitigate a lost circulation event.

In some embodiments, the method 656 may include selecting a lost circulation treatment from the identified lost circulation treatments. In some embodiments, the identified lost circulation treatments may include one or more LCMs to be used in case of a lost circulation event, and selecting the lost circulation treatment may include selecting an LCM from the one or more identified LCMs. This may provide the operator with selections of suitable treatments and/or LCMs, and select the best treatment or LCM for the user. In some embodiments, the LCM may be selected based on a particle size of the LCM and a thickness of the fracture.

In some embodiments, the method 656 may be performed prior to drilling the wellbore, or in the wellbore planning phase. This may allow the drilling operator to procure and stockpile the selected LCM before drilling. If the selected LCM is on site or nearby while drilling, the impact of the lost circulation event may be reduced. For example, the down time resulting from the lost circulation event may be reduced, thereby allowing drilling of the wellbore to recommence without delay.

In some embodiments, building the fracture model may include extrapolating the fracture characteristics between offset wellbores. In some embodiments, building the fracture model may include identifying one or more risk areas or zones. For example, based on the fracture properties in the fracture model, the drilling operator may identify one or more risk zones associated with the fracture properties. In some embodiments, receiving the geological information includes receiving offset wellbore data of lost circulation events in the formation.

Figure 7:
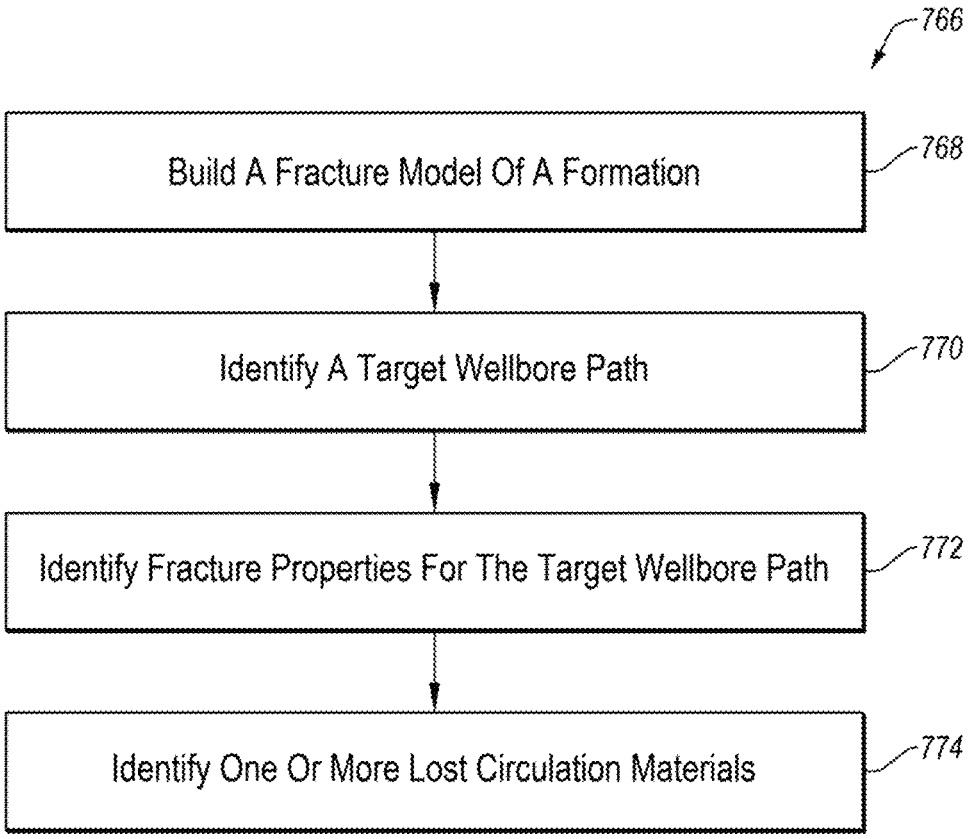
FIG. 7 is a flowchart of a method for planning a wellbore, according to at least one embodiment of the present disclosure.

FIG. 7 is a flowchart of a method 766 for planning a wellbore, according to at least one embodiment of the present disclosure. The method 766 includes, before performing a drilling operation, building a fracture model of a formation through which a wellbore will be drilled at 768. The fracture model may include fracture characteristics that are extrapolated from one or more offset wellbores. The fracture characteristics may be extrapolated using survey data obtained from the one or more offset wellbores.

In some embodiments, a target wellbore path may be identified that passes through the formation at a particular location at 770. In some embodiments, using the fracture model, the method 766 may include identifying expected fracture properties for the target wellbore path at 772. For example, using the location of where the target wellbore path intersects the formation and the fracture characteristics of the fracture model at the intersection location, expected fracture properties of the formation may be identified. Based at least in part on the expected fracture properties, one or more LCMs may be identified for the target wellbore path at 774. The LCMs may be used in case of a lost circulation event. The method 766 may further include procuring the identified one or more LCMs prior to drilling the wellbore and/or utilizing the LCMs in case of a lost circulation event.

Figure 8:
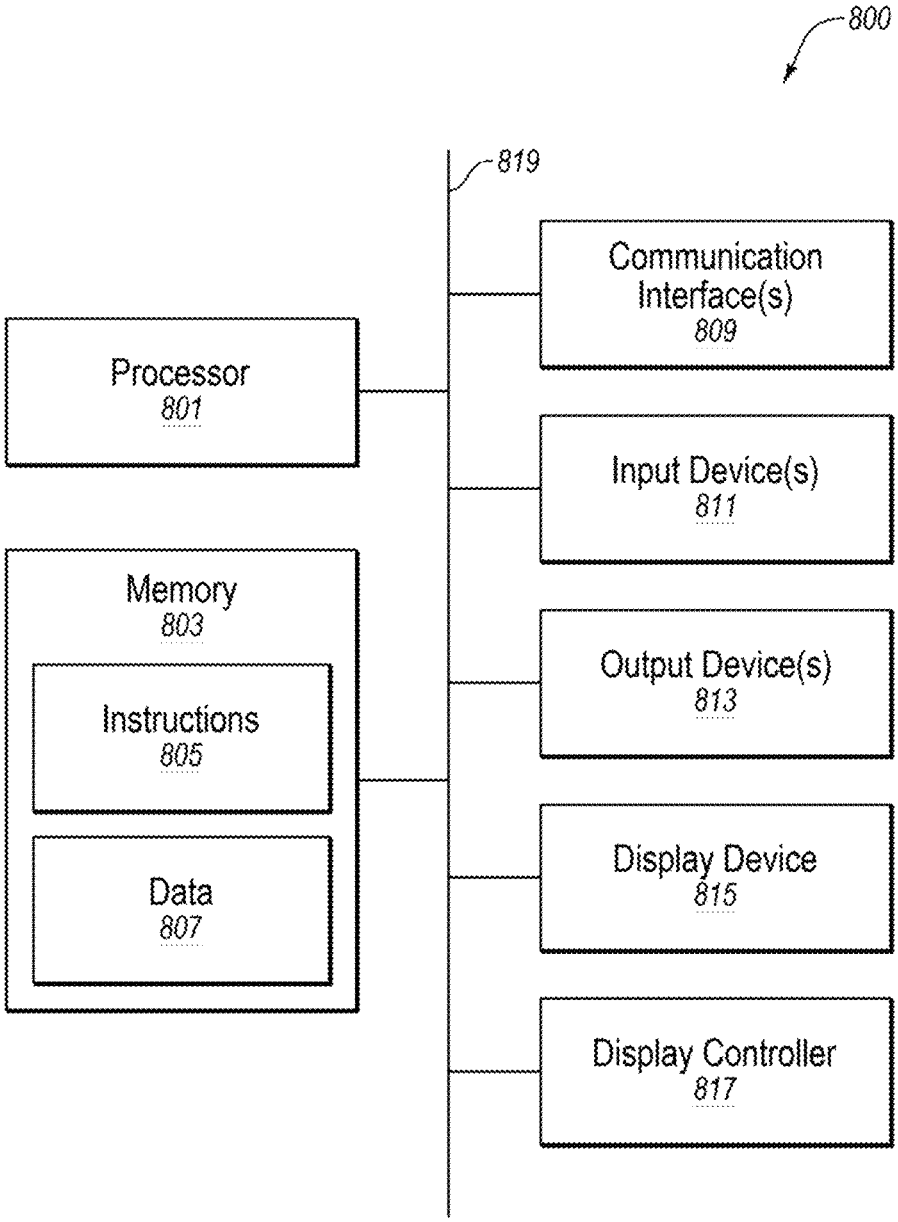
FIG. 8 is a representation of a computing system, according to at least one embodiment of the present disclosure.

FIG. 8 illustrates certain components that may be included within a computer system 819. One or more computer systems 819 may be used to implement the various devices, components, and systems described herein.

The computer system 819 includes a processor 801. The processor 801 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 819 of FIG. 8, in an alternative configuration, a combination of processors (e.g., an ARM and DSP) could be used.

The computer system 819 also includes computer-readable media such as memory 803 in electronic communication with the processor 801. The memory 803 may be any electronic component capable of storing electronic information, and may be local or remote relative to the processor 801. In some embodiments, the memory 803 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof. Memory 803 may also be referred to as computer-readable storage media. Additional or alternative types of computer-readable media may also be used. For instance, communication links, carrier waves, and other types of computer-readable communication media may be used. Computer-readable communication media is distinct from computer-readable storage media; however, computer-readable media may encompass and include both computer-readable storage media and computer-readable communication media.

Instructions 805 and data 807 may be stored in the memory 803 or otherwise provided by the computer-readable media for access by the processor 801. When accessed by the processor 801, the instructions 805 may be executable by the processor 801 to implement some or all of the functionality disclosed herein. Executing the instructions 805 may involve the use of the data 807 that is stored in the memory 803 or accessible through other computer-readable media. Any of the various examples of modules and components described herein may be implemented, partially or wholly, as instructions 805 stored in memory 803 or accessible in computer-readable media and executed by the processor 801. Any of the various examples of data described herein may be among the data 807 that is stored in memory 803 or accessed from other computer-readable media and used during execution of the instructions 805 by the processor 801.

A computer system 819 may also include one or more communication interfaces 809 for communicating with various electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a BLUETOOTH® wireless communication adapter, and an infrared (IR) communication port. In some embodiments, the communication interfaces 809 may allow a processor 801 to communicate with remote computer-readable media such as memory 803, or with remote computing systems that include memory 803 or other computer-readable media.

A computer system 819 may also include one or more input devices 811 and one or more output devices 813. Some examples of input devices 811 include a keyboard, mouse, microphone, remote control device, button, joystick, trackball, touchpad, and lightpen. Some examples of output devices 813 include a speaker and a printer. One specific type of output device that is typically included in a computer system 819 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into text, graphics, and/or moving images (as appropriate) shown on the display device 815.

The various components of the computer system 819 may be coupled together by one or more buses, which may include a power bus, a control signal bus, a status signal bus, a data bus, etc. For the sake of clarity, the various buses are illustrated in FIG. 8 as a bus system 819.

The embodiments of the wellbore planner have been primarily described with reference to wellbore drilling operations; the wellbore planners described herein may be used in applications other than the drilling of a wellbore. In other embodiments, wellbore planners according to the present disclosure may be used outside a wellbore or other downhole environment used for the exploration or production of natural resources. For instance, wellbore planners of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for drilling a wellbore in a formation, comprising:

i) receiving geological information about the formation;

ii} identifying fracture characteristics in the formation using the geological information of i);

iii) building a fracture model of the formation using the fracture characteristics of ii), wherein the fracture model includes a) at least one fracture property associated with fractures in the formation and b) fracture network properties associated with a fracture network in the formation for particular geographical coordinates, wherein the fracture network properties of b) relate to fracture size, fracture density, fracture connectivity, and drilling fluid transmissibility, wherein the drilling fluid transmissibility is determined from the fracture density and the fracture connectivity; and iv) after the building the fracture model of iii), drilling the wellbore, and, when the drilling passes through a risk zone in the formation which is at risk for lost circulation as characterized by the fracture network properties of the fracture model of iii), using lost circulation material in the drilling to mitigate a lost circulation event, wherein the lost circulation material is selected by comparing at least one fracture network property of the fracture model that is related to fracture size to physical properties of different lost circulation materials.

2. The method of claim 1, wherein the receiving the geological information includes receiving the geological information from a borehole image.

3. The method of claim 1, wherein the geological information includes at least one of seismic information or resistivity information.

4. The method of claim 3, wherein the geological information includes the resistivity information, and wherein the resistivity information includes a difference in resistivity between a fracture of the fractures in the formation and a solid formation.

5. The method of claim 1, wherein the at least one fracture property further includes at least one of a thickness, a width, a direction, a dip, or a strike.

6. The method of claim 1, wherein the at least one fracture network property of the fracture model that is related to fracture size comprise an average thickness or a thickness profile of the fracture network.

7. The method of claim 6, wherein the physical properties of different lost circulation materials include a particle size distribution.

8. The method of claim 1, further comprising procuring, prior to the drilling of iv), the selected lost circulation material.

9. The method of claim 1, wherein the building a fracture model of iii) includes extrapolating the fracture characteristics between offset wellbores.

10. The method of claim 1, wherein the receiving geological information about the formation of i) includes receiving offset wellbore data of other lost circulation events in the formation.

11. The method of claim 1, wherein the properties of various lost circulation materials include at least one of particle shape, maximum particle size, or minimum particle size.

12. The method of claim 1, wherein the selection of the lost circulation material employs a machine learning model.

13. The method of claim 1, wherein the building of the fracture model of iii) employs a machine learning model.

14. The method of claim 1, wherein the identifying of the fracture characteristics of ii) employs a machine learning model.

* * * * *